US006273764B1

(12) United States Patent
Harting et al.

(10) Patent No.: US 6,273,764 B1
(45) Date of Patent: Aug. 14, 2001

(54) DOUBLE CONTACT ELEMENT

(75) Inventors: Dietmar Harting, Espelkamp; Ralf Bokamper; Heinz Lambrecht, both of Lubbecke; Stephan Schreier, Rahden, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/538,712

(22) Filed: Mar. 30, 2000

Related U.S. Application Data

(63) Continuation-in-part of application No. 09/128,327, filed on Aug. 3, 1998.

(30) Foreign Application Priority Data

Aug. 7, 1997 (DE) ..... 197 34 175

(51) Int. Cl.[7] ..... H01R 11/09

(52) U.S. Cl. ..... 439/723; 439/851

(58) Field of Search ..... 439/723, 724, 439/217, 221, 222, 223, 224, 741, 742, 851, 891, 908, 874, 877, 389, 751, 843

(56) References Cited

U.S. PATENT DOCUMENTS

| | | | | |
|---|---|---|---|---|
| 2,147,915 | * | 2/1939 | Morris | 439/742 |
| 3,099,510 | * | 7/1963 | Piorunneck | 439/851 |
| 3,374,456 | * | 3/1968 | Evans | 439/224 |
| 3,852,700 | * | 12/1974 | Haws | 439/225 |
| 4,133,599 | * | 1/1979 | Powell | 439/843 |
| 4,921,456 | * | 5/1990 | French | 439/851 |
| 4,988,311 | * | 1/1991 | Tanzola | 439/404 |
| 5,725,400 | * | 3/1998 | Morikawa et al. | 439/874 |
| 5,944,563 | * | 8/1999 | Nagafuji | 439/751 |

* cited by examiner

*Primary Examiner*—Gary Paumen
*Assistant Examiner*—Ross Gushi
(74) *Attorney, Agent, or Firm*—Cook, Alex, McFarron, Manzo, Cummings & Mehler, Ltd.

(57) ABSTRACT

A multiple electrical connector comprising a terminal strip having a bore extending therethrough, a pair of conductor sockets mounted back to back on the terminal strip at the bore and an electrical terminal attached to the terminal strip. One of the pair of conductor sockets has a post and the other has a post receiving bore with the post and the post receiving bore aligned with the terminal strip bore and with each other. The connector socket post extends through the terminal strip bore and into the post receiving bore of the other of the connector sockets with the socket post riveted to the other connector socket.

1 Claim, 9 Drawing Sheets

DOUBLE CONTACT ELEMENT

This is a continuation-in-part of our U.S. patent application Ser. No. 09/128,327, filed Aug. 3, 1998.

The invention relates to a double contact element with a terminal element, wherein the double contact element consists of two contact elements connected to one another, the contact elements are axially aligned and at their rear end sides are electrically conductively connected by appropriately formed connecting means, and at the connection point a terminal element provided with a terminal for electric conductors is inserted.

The connection of electric consumers to a supply line is currently effected in different ways depending upon the field of use. In the International Protection 20 sector, for example in a switchgear cabinet, wire jumpers are used for the connection of modules. The connection is established mainly via screw terminals which at the same time either belong directly to the consumer or are connected thereto via cables.

In sectors with a higher degree of protection, for example International Protection 54 sector and upwards, plug connectors or cables combined with heavy-gauge screw couplings lead into the consumers and out again. The branching within the consumer then takes place directly, possibly with the aid of terminal blocks inside the device.

Disadvantages of the above described approaches reside in the strong possibility of processing faults (screw terminals), non detachability (wire jumpers) and in the wiring outlay and assembly in pluggable systems.

GB 2 011 192 A has disclosed a double contact element whose contact elements are connected to one another at their end sides via connecting means. Here the connecting means are provided with a terminal element comprising a terminal for an electric conductor.

In addition, from DE 29 38 133 A1 it is known to provide the end of a contact element with a compression-type socket into which the end of a conductor is insertable and in the case of which the conductor is connected to the contact element upon the compression of the socket.

The object of this invention is to develop a double contact element of the type referred to in the introduction in that the contact element is composed of simple components which can be produced cost-effectively.

This object is achieved in that the one contact element is provided with a rivet post and the other contact element is provided with a corresponding bore into which the rivet post is insertable, that the terminal element is provided at one end with a bore through which the rivet post extends, and that the two contact elements are riveted to one another after the insertion of the terminal element.

The advantages attained by means of the invention consist in particular in that the electrical and mechanical connection between the two plug contacts of the double contact elements and a terminal element is established without the use of additional connecting elements. Here the entire connection establishment takes place in one operating step.

Such contact elements in the form of double contacts and comprising a terminal element can be used in industry for the connection of consumers, current sources and electronic assemblies. Electrically, the branching takes place in parallel to the conductor run extending between the two individual contacts connected to one another via a rivet connection.

The conductor run is looped through via the double contact.

Exemplary embodiments of the invention are illustrated in the drawings and will be described in detail in the following.

Figure 1:
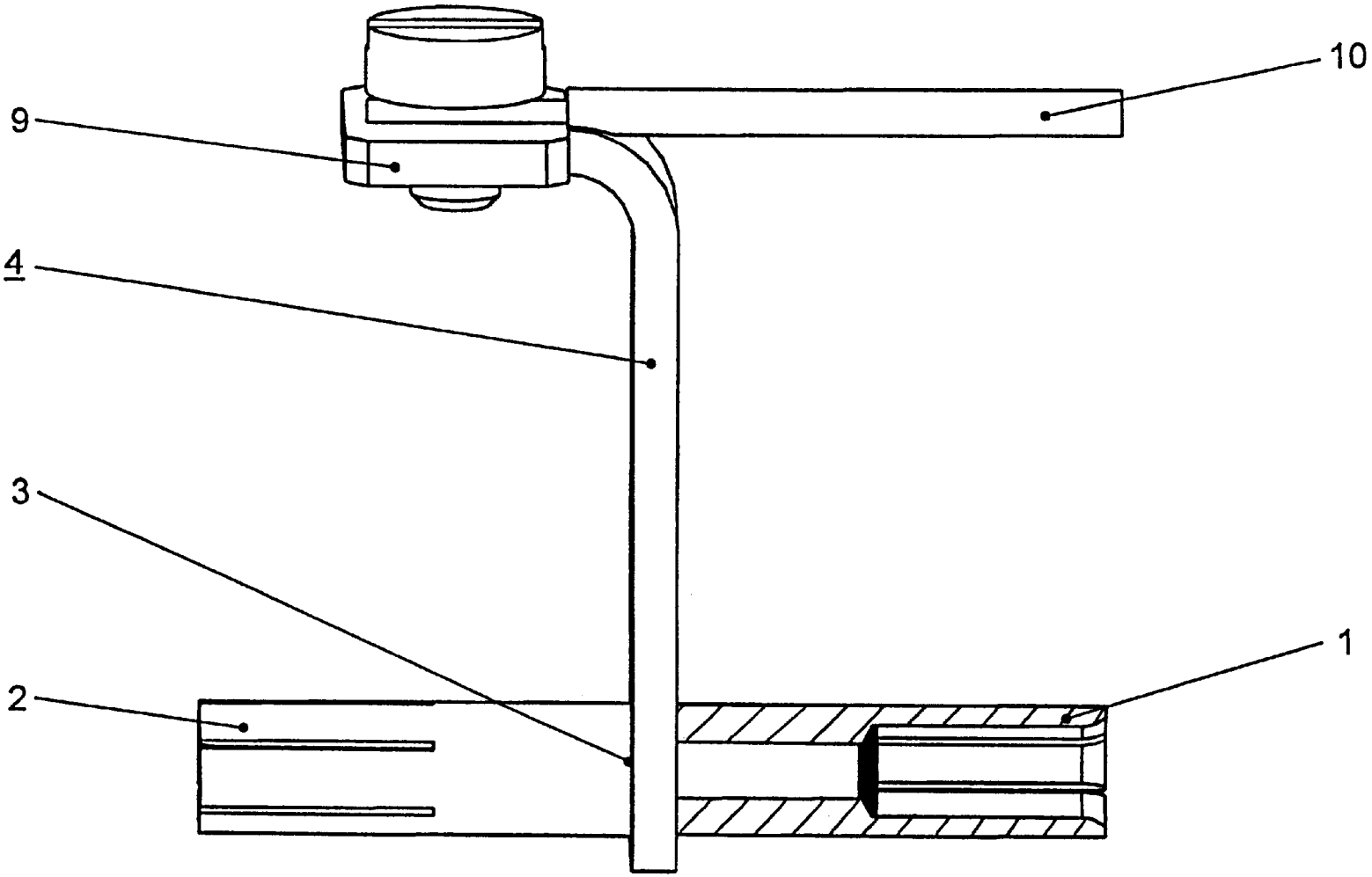
FIG. 1 is a diagram of a double contact element.
Figure 2:
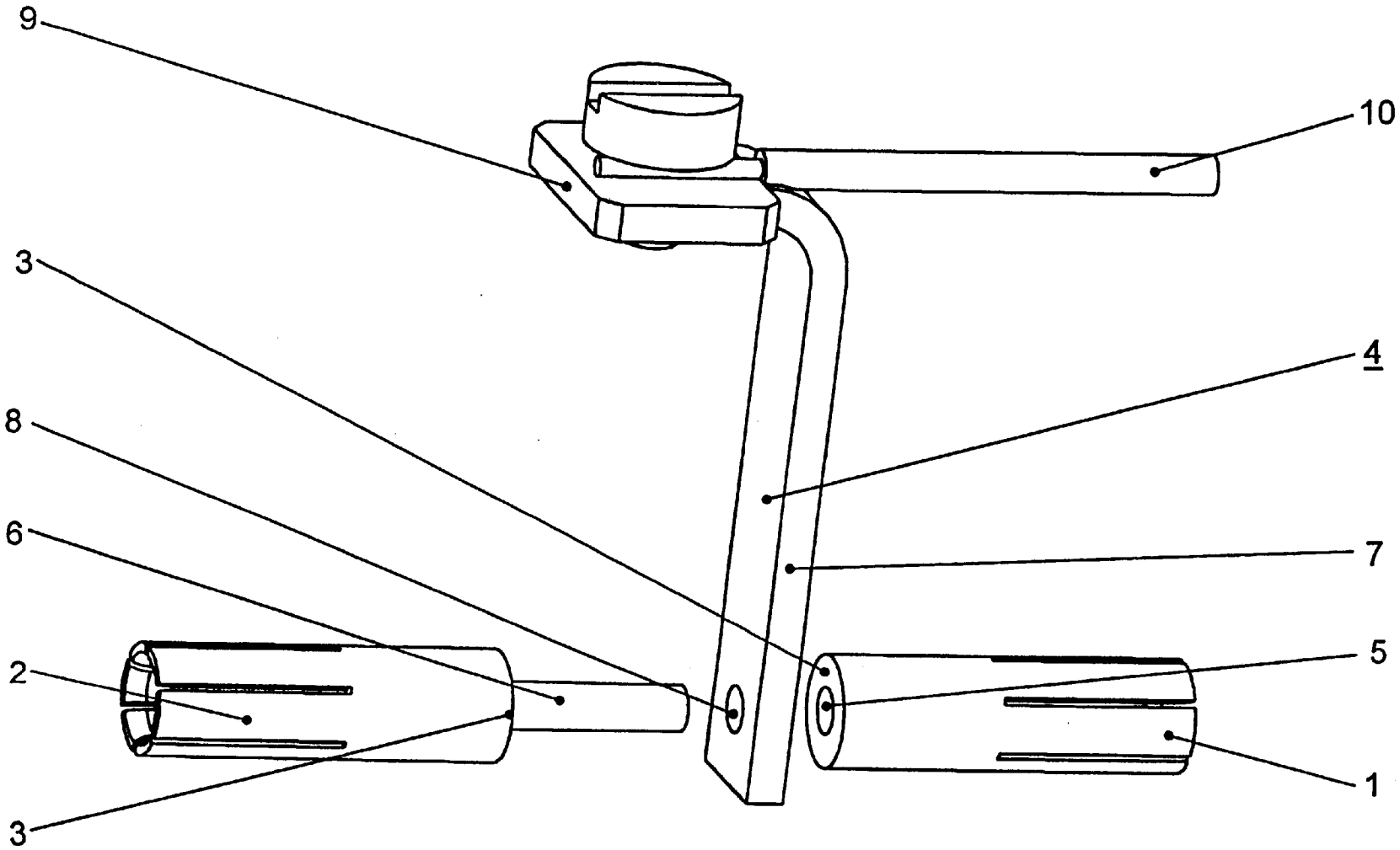
FIG. 2 is a diagram of the double contact element according to FIG. 1 in an exploded view.

The double contact element illustrated in FIGS. 1 and 2 substantially consists of two separately produced contact elements 1, 2 which in the axial direction (relative to the plug-in direction) are connected to one another at their rear end sides 3 with an interposed terminal element 4.

The contact elements 1, 2 here have the form of bush contacts, although it is also optionally possible for one of the contact elements to be formed as a pin contact. Of the two contact elements, the one contact element 1 comprises a bore 5 which extends from the rear end side 3 into the interior of the contact element. The other contact element 2 is provided on its rear end side 3 with a rivet post 6 whose diameter is such that the post can be plugged into the bore 5.

The contact elements 1, 2 are preferably produced from solid material as turned parts. However, they can also be produced from sheet metal material as punched-bent parts.

The terminal element 4 is preferably produced from a sheet metal strip 7 or a turned part with parallel flat areas and at one end comprises a bore 8 dimensioned such that the rivet post 6 of the contact element 2 can be inserted through said bore. The other end of the terminal element is provided with a screw terminal 9 for the connection of an electric conductor 10. Optionally a plug-, solder-, insulation piercing-, crimp- or rivet terminal can also be provided here. For other applications it can optionally also be provided that this end of the terminal element is formed as a press-in zone for direct impression into a bore of a circuit board.

In the production of the double contact element, with its bore 8 the end of the terminal element is firstly placed onto the rivet post 6 of the contact element 2, whereupon the rivet post is inserted into the bore 3 of the contact element 1. Then the riveting of the rivet post is effected from the inside of the contact element 1. A permanent mechanical connection is now established between the two contact elements 1, 2 including the terminal element. At the same time these parts can be electrically conductively connected to one another.

To achieve good contacting between the contact elements 1, 2 and the terminal element 4, it can be provided that the diameter of the rivet post 6 is slightly oversized compared to the bore 8 and is impressed therein upon the assembly of the elements. Optionally, the bore 8 can also be provided with a contact-improving corrugation or can be of oval formation.

Figure 3:
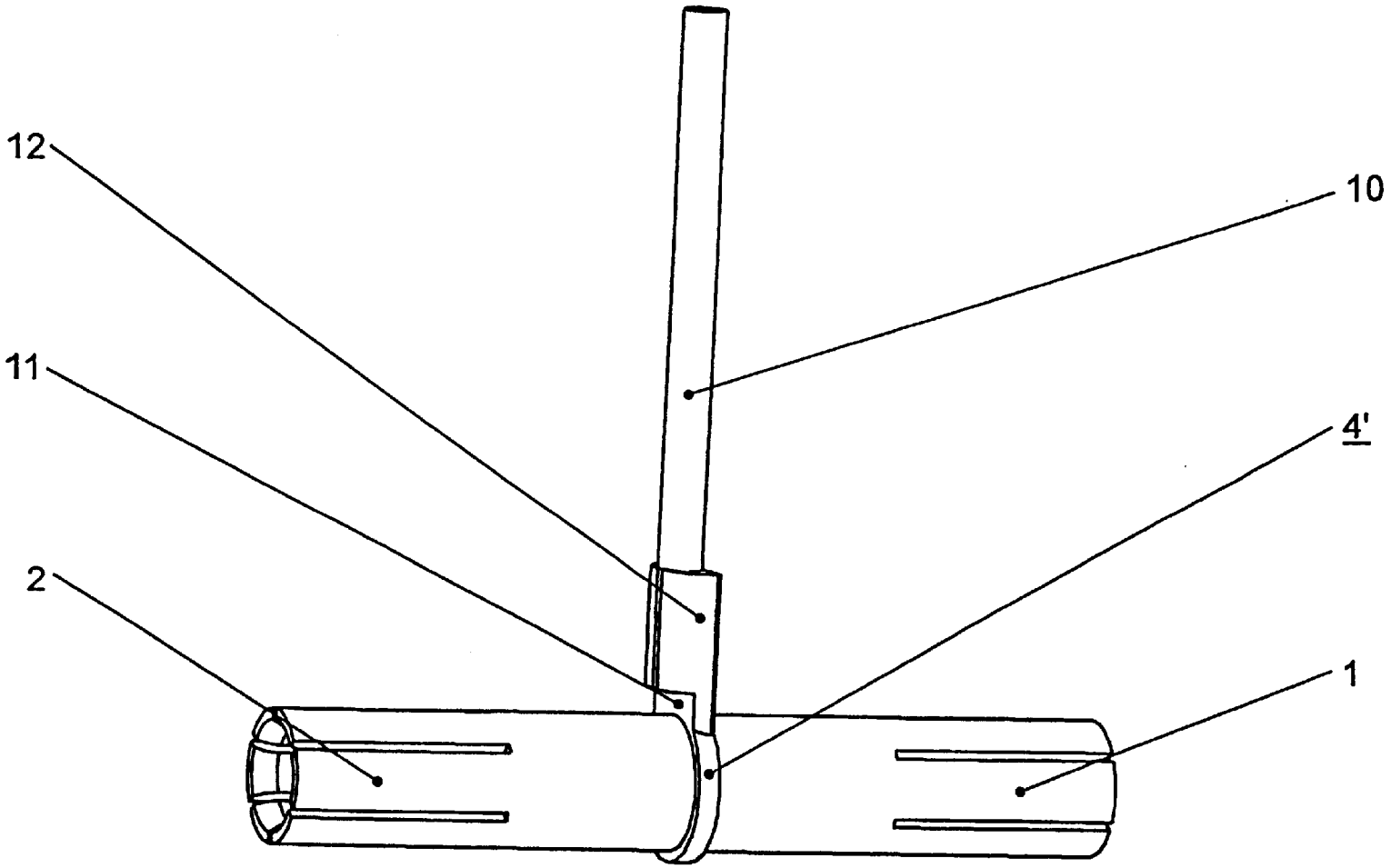
FIG. 3 is a diagram of a modified double contact element.

FIG. 3 illustrates a modified double contact element. This double contact element likewise consists of two contact elements 1, 2. However, here the terminal element 4' comprises a loop 11 provided with a crimp terminal 12 for the connection of an electric conductor 10.

Figure 4:
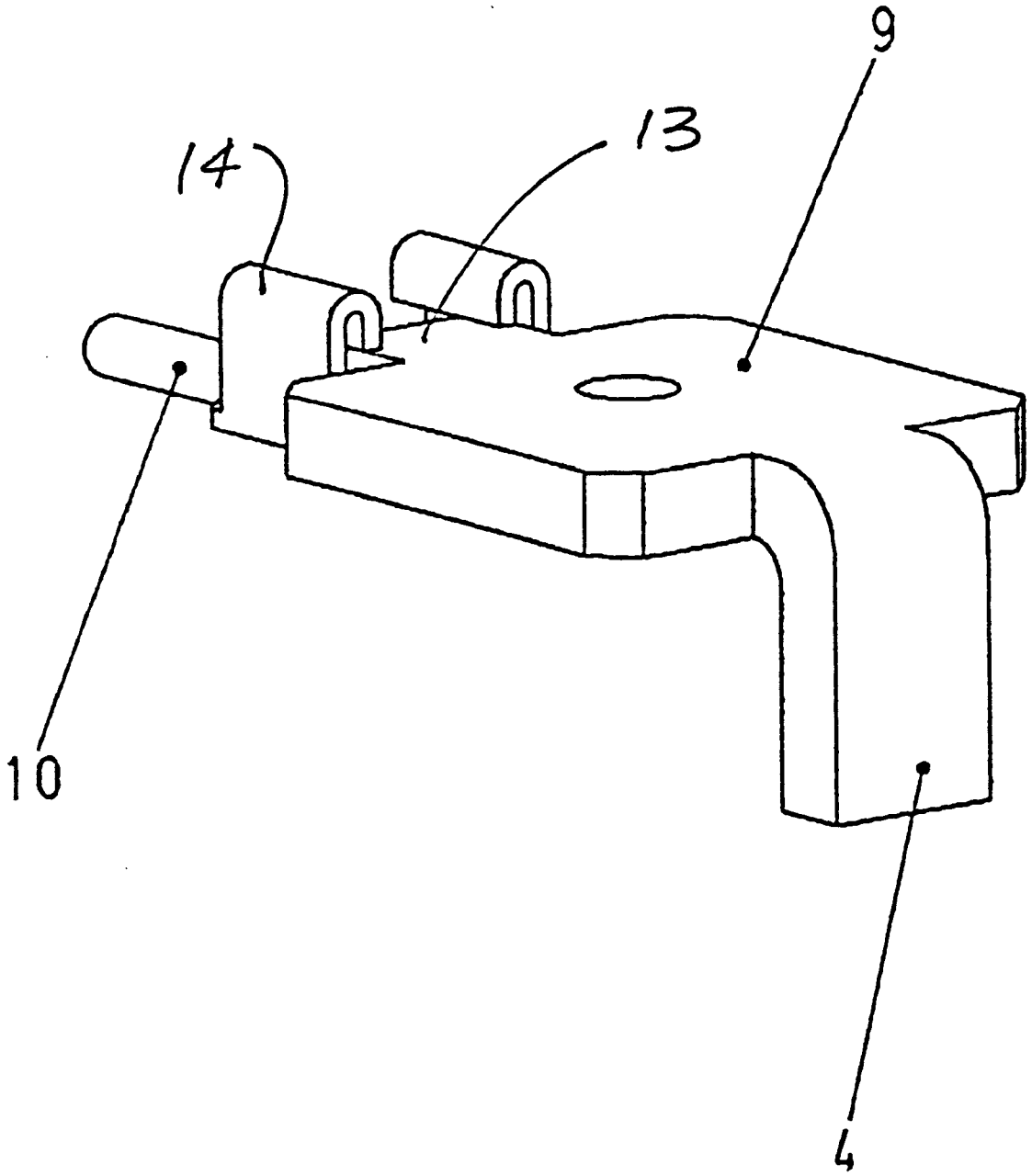
FIG. 4 is a partial view of the terminal showing a plug terminal.

FIG. 4 illustrates a portion of a terminal element 4 having a plug 13 received in a clamp 14 attached to a conductor 10.

Figure 5:
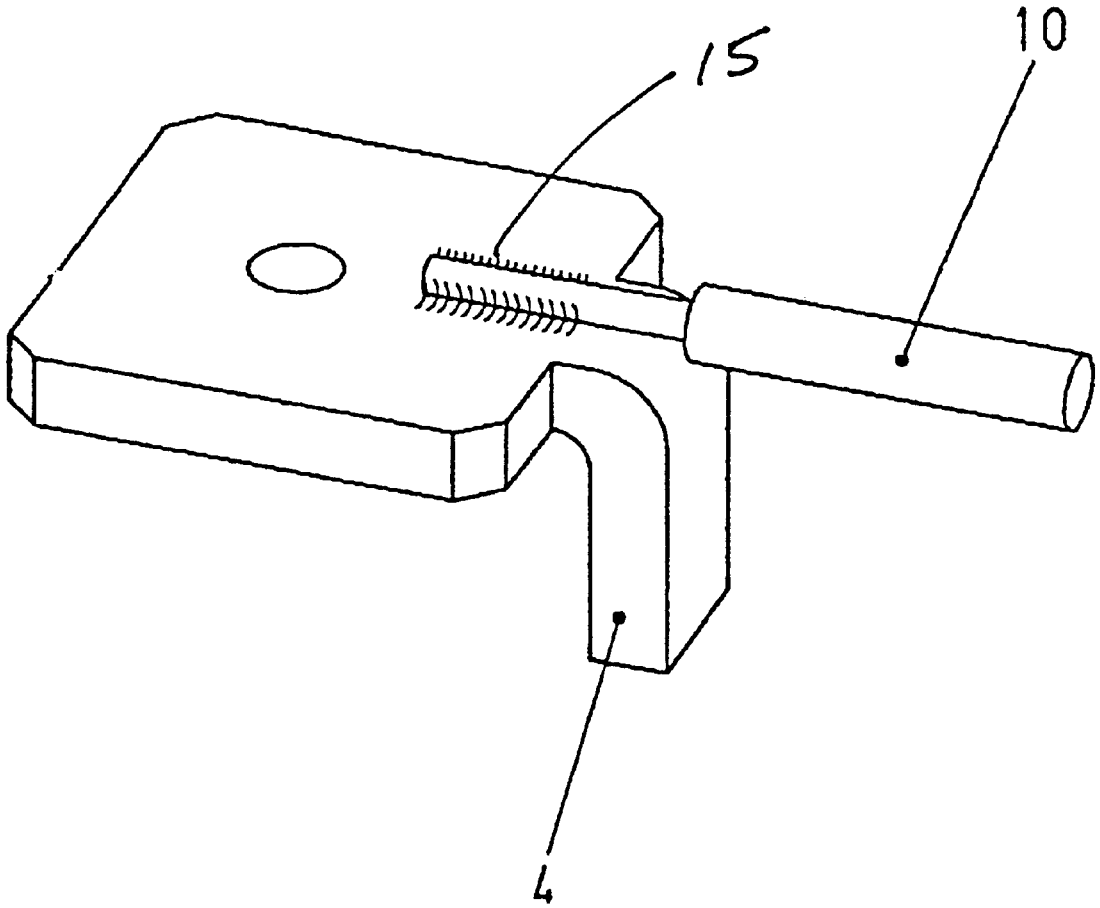
FIG. 5 is a partial view of the terminal element showing a solder terminal.

FIG. 5 illustrates a portion of a terminal element 4 having an electrical conductor 10 soldered thereto at 15.

Figure 6:
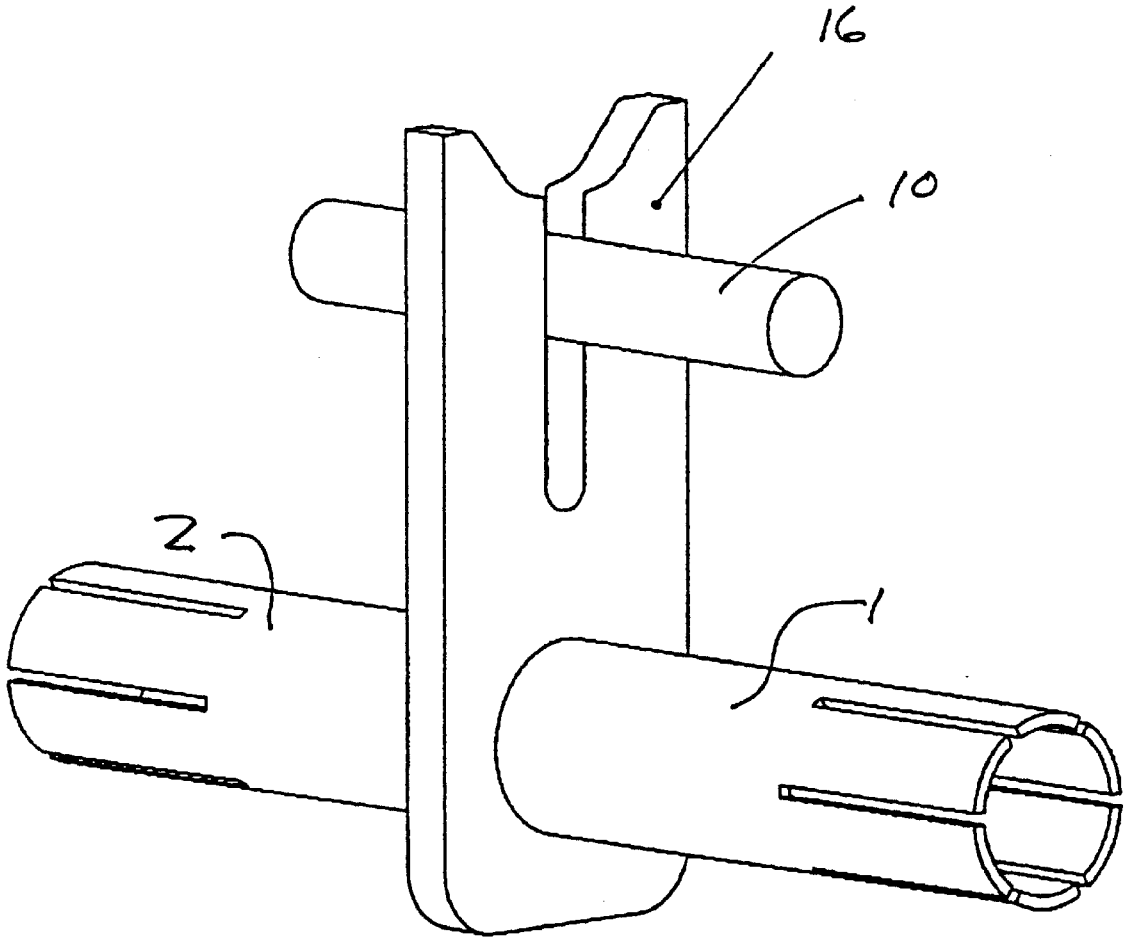
FIG. 6 is a view of the terminal element showing an insulation piercing terminal.

FIG. 6 illustrates a portion of a terminal element having an insulation piercing member 16 engaging an insulated electrical conductor 10.

Figure 7:
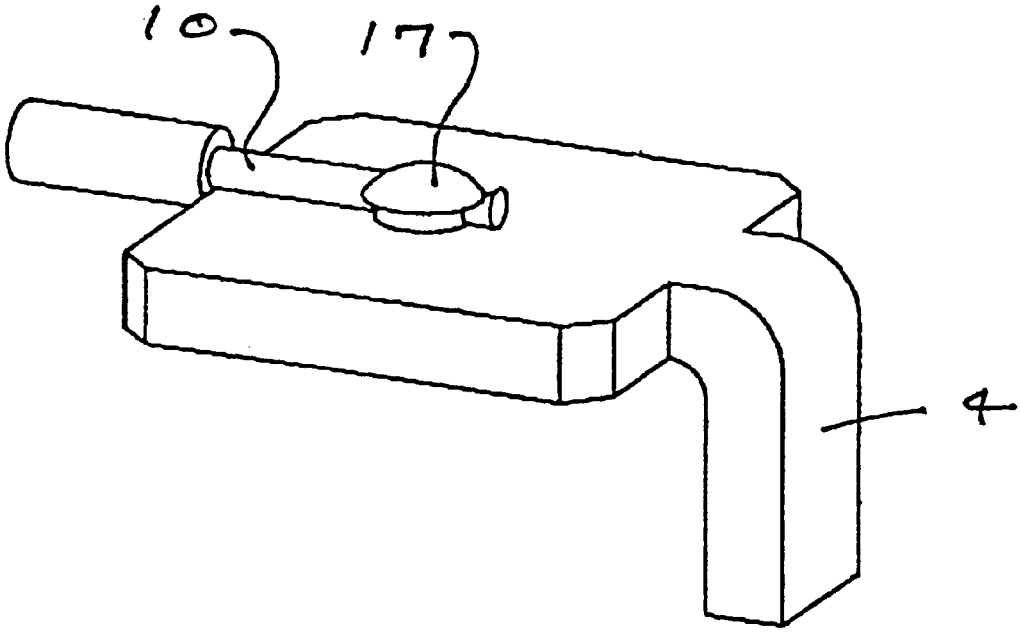
FIG. 7 is a partial view of the terminal element showing a rivet terminal.

FIG. 7 illustrates a portion of a terminal 4 having a rivet 17 connecting an electrical conductor 10 to the terminal 4.

Figure 8:
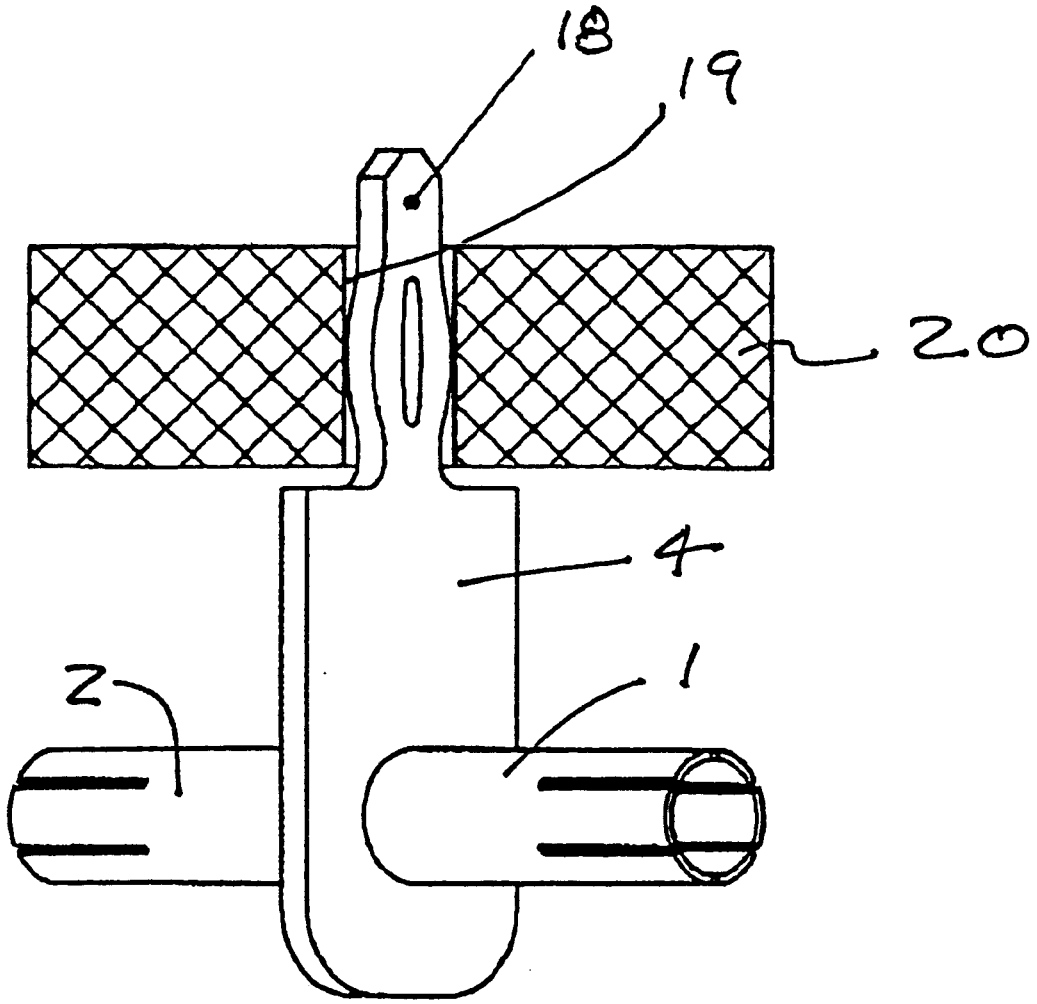
FIG. 8 shows a circuit board press-in terminal.

FIG. 8 illustrates a terminal 4 having a press-in zone 18 for insertion into a bore 19 of a circuit board 20.

Figure 9:
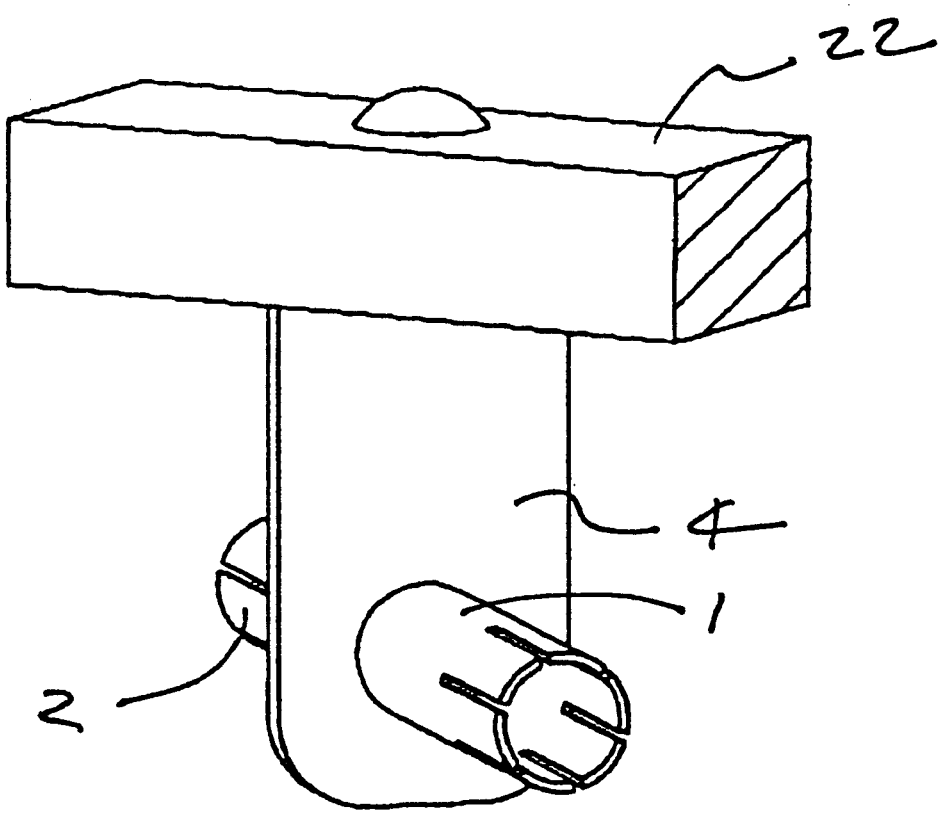
FIG. 9 shows a terminal element with a riveting zone for the attachment by rivets of other electrical branching elements.

FIG. 9 illustrates a terminal 4 having a sheet metal strip with a riveting zone for the riveting of other electrical branching elements such as bus bar 22 thereto.

What is claimed is:

1. A multiple electrical conductor comprising:

a terminal strip having a loop defining a bore extending therethrough and a crimp terminal, a pair of conductor sockets mounted back to back on said terminal strip at said bore of said loop, said crimp terminal of said terminal strip formed and adapted to receive an electrical conductor, one of said pair of conductor sockets having a post and the other of said pair of conductor sockets having a post receiving bore with said post and said post receiving bore aligned with said terminal strip loop bore and with each other, said conductor socket post extending through said terminal strip loop bore and into said post receiving bore of said other of said pair of conductor sockets, and said socket post riveted to said one of said pair of conductor sockets.

* * * * *